United States Patent [19]

Hannigan

[11] Patent Number: 4,830,338

[45] Date of Patent: May 16, 1989

[54] WINDOW OPENING FACILITATOR

[76] Inventor: John D. Hannigan, 12737 Holiday La., Bowie, Md. 20716

[21] Appl. No.: 224,368

[22] Filed: Jul. 26, 1988

[51] Int. Cl.[4] ..... B66F 3/00

[52] U.S. Cl. ..... 254/130

[58] Field of Search ..... 254/120, 129, 130

[56] References Cited

U.S. PATENT DOCUMENTS 1,960,255 5/1934 Tyroff ..... 254/130

*Primary Examiner*—Frederick R. Schmidt

*Assistant Examiner*—David A. Holmes

*Attorney, Agent, or Firm*—L. Lawton Rogers, III; Joseph M. Killeen

[57] ABSTRACT

A device to facilitate open windows comprising a lever arm with a delta shaped lead edge and incorporating a pivot pin; and a frame with a series of notches to receive the pivot pin at selectable fulcrum points. Both the delta shaped lead edge of the arm and the bottom lead edge of the frame are rounded to "roll", allowing steady, continuous pressure on the window sash throughout the opening process.

11 Claims, 1 Drawing Sheet

WINDOW OPENING FACILITATOR

BACKGROUND OF THE INVENTION

1. Field of the Invention

The invention is an improved design on mechanical devices that facilitate opening windows.

2. Description of the Prior Art

References cited (attached hereto)

| U.S. Pat. Nos. | | | |
|---|---|---|---|
| 2,010,680 | 8/06/1935 | Van Leuven | 254-131 |
| 2,186,944 | 1/16/1940 | Waldheim | 254-131 |
| 2,670,923 | 3/02/1954 | Chiles | 254-129 |
| 2,766,008 | 10/09/1956 | Hurd | 254-129 |
| 3,331,586 | 7/18/1967 | Primoff | 254-123 |

Previously patented window opening devices manifest designs that would use mechanical advantage to open windows. Each has one or more of the following drawbacks:

1. Would require modification or addition to the window sash;
2. Have limited range of motion, not enabling user to open a window completely;
3. Need two hands to operate;
4. Have a narrow leading edge, thus focusing stress that could damage the window sash;
5. Have an off-center line of thrust, causing lateral stress and binding of the window sash in the frame;
6. Are excessively complicated needing constant, involved adjustments, adding to the difficulty of use.

This invention eliminates these problems.

SUMMARY OF THE INVENTION

The invention is an improvement over previously patented devices for opening windows in that it allows a person to use only one hand while efficiently applying leverage over the full height of the window sash being opened.

DESCRIPTION OF THE PREFERRED EMBODIMENT

Figure 1:
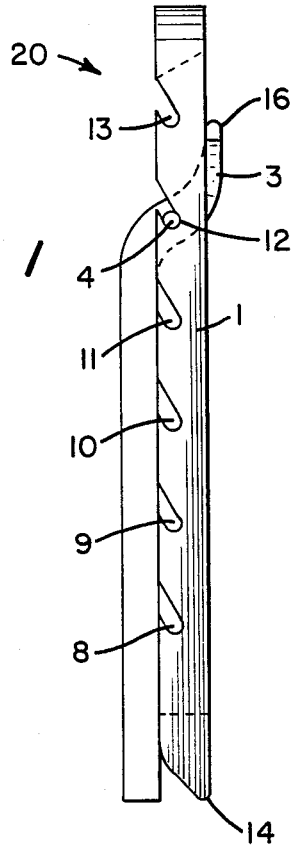
FIG. 1 shows the side view of the window opening facilitator in the rest position.
Figure 2:
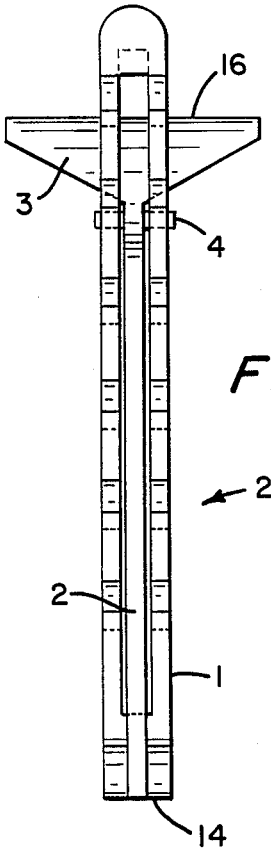
FIG. 2 shows the front view of the window opening facilitator in the rest position.
Figure 3:
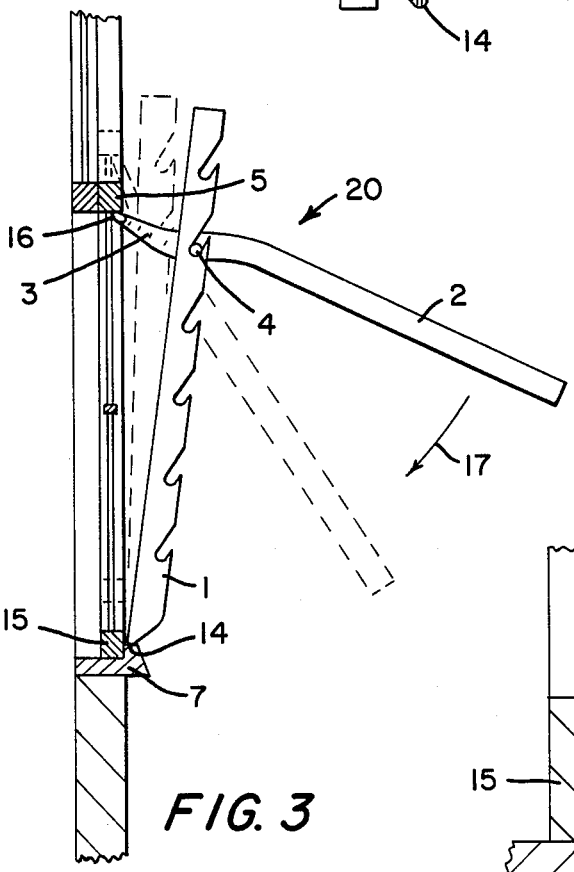
FIG. 3 shows the relative position of the device and the window sash before and after completion of the initial motion.
Figure 4:
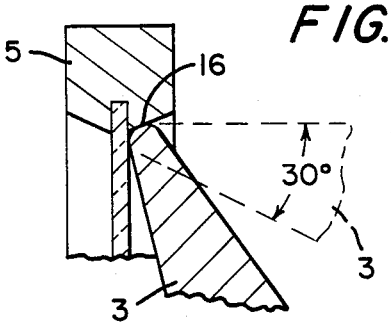
FIG. 4 shows an enlarged side view of the relative positions of the rounded "lip" of the leading edge of the arm lever before and after the complete motion.
Figure 5:
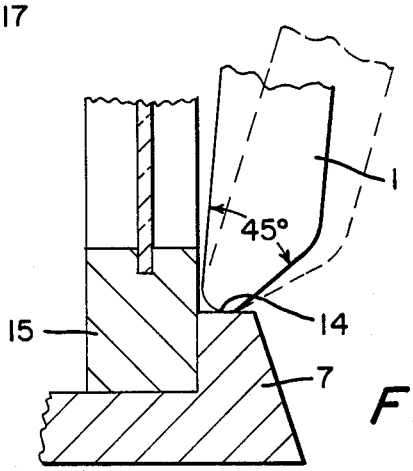
FIG. 5 shows an enlarged side view of the relative positions of the rounded leading edge of the frame before and after the complete motion.

Referring to FIG. 1, the embodiment 20 consists of a frame 1 and lever arm 2 fabricated of wood, metal, plastic or combination of same or any other appropriate material. Referring to FIG. 3, proper positioning of the device is accomplished by placing the leading edge of the frame 14 on the window sill 7 while placing the leading edge or "lip" 16 of the lever arm under the upper portion of the sash 5 after selecting the appropriate fulcrum point that would place the blade 3 perpendicular to the window sash FIG. 4. The bottom lead edge FIG. 5 of the frame consists of a $\frac{1}{4}''$ dia. rounded "lip" 14 tapered back 45 degrees, allowing the frame to "roll" forward as the action of the lever arm FIG. 3 also with a $\frac{1}{4}''$ dia. rounded lip 16 on the lead edge of the blade 3 draws the frame closer to the window sash. Also, the $\frac{1}{4}''$ dia. lip on the frame 14 readily maintains its position, easily functioning on a sill as narrow as $\frac{1}{2}''$. The frame 1 has a series of notches on one side 8, 9, 10, 11, 12 & 13 for receiving a pivot pin 4 attached to the arm 2 to provide a series of spaced, selectable fulcrum points. The spacing of these fulcrum points at 4" apart is such that the completed mechanical action of the lever arm with a travel of over 5" leaves an adequate "next higher" fulcrum to repeat the motion. Also, the number of fulcrum points allows the user to apply mechanical advantage over virtually the height of any standard sash-type window. This is accomplished after using fulcrum 13 with the leading edge 3 applied under the upper portion of the sash 5, by placing the arm lever in fulcrum 8 with the leading edge 16 of the blade 3 placed below the window sash 15 (not shown). Referring to FIG. 1, the lever arm 2 is designed to lie flat on the frame 1 for ease of storage. The forward end of the lever arm consists of a 6" wide blade 3 as shown in FIG. 2 for distribution of stress as well as providing the lateral stability required for one-hand operation and tapered 30 degrees as shown in FIG. 4 to allow motion of the lever arm 2 to total 60 degrees 17.

Having described my invention, I claim:

1. A device operable with one hand for assisting the opening of vertically mounted windows restricted as to horizontal movement by a window frame, said device providing a laterally stable, vertically upward force with a significant mechanical advantage over a substantial range of the movement of the window within the window frame from a lower closed position to a higher open position, said device comprising:

(a) a rigid lever arm having forwardly and rearwardly extending portions connected by an intermediate portion, said forwardly extending portion terminating in a window engaging blade having a width significantly greater than the width of said intermediate portion so as to spread the contact of the upward force to be applied to the window along a line of contact with a downwardly facing surface of the window sufficiently large to resist lateral movement of the device when operated by one hand, the window engaging end of said blade having a rounded end to facilitate the pivoting thereof about the line of contact with the window when in use, said rearwardly extending portion being approximately four times the length of said forwardly extending portion to provide a mechanical advantage and adapted at the free end thereof to be grasped by the human hand, and said intermediate portion having a pivot pin extending laterally therethrough to thereby enhance the lateral stability of the device when operated by one hand; and (b) an elongated frame having a length approximately the length of the lever arm, said frame having a longitudinal slot extending from a point adjacent the lower end to a point adjacent the upper end from the window-facing side thereof through said frame to the user-facing side to receive the intermediate portion of said lever arm therethrough, the user-facing side of said frame having a plurality of upwardly opening notches spaced along the length thereof within the length of said slot on opposite lateral sides thereof to selectively receive said laterally extending pivot pin, the lower end of said frame being tapered toward the window and terminating in a rounded point to facilitate the pivoting of said frame toward and away from the window when said device is in use, whereby pressing down on the rearwardly extending portion of said lever arm with one hand with the lower end of said frame positioned against the sill of the window and with said blade positioned against a downwardly facing surface of the window will provide a mechanical advantage to assist in opening the window with one hand.

2. The device as defined in claim 1 wherein said window engaging blade has a width not less than about six inches.

3. The device as defined in claim 1 wherein said pivot pin extends laterally a distance on both sides not less than the width of said lever arm.

4. The device as defined in claim 1 wherein said rounded end is rigid.

5. The device as defined in claim 1 wherein said rounded point is rigid.

6. The device as defined in claim 1 wherein said intermediate portion is S-shaped.

7. A device operable with one hand for assisting the opening of vertically mounted windows restricted as to horizontal movement by a window frame, said device providing a laterally stable, vertically upward force with a significant mechanical advantage over a substantial portion of the range of movement of the window within the window frame from a lower closed position to a higher open position, said device comprising:

(a) a rigid lever arm having forwardly and rearwardly extending, spaced apart, generally parallel portions connected by a generally S-shaped portion, said forwardly extending portion terminating in a window engaging blade having a width significantly greater than the width of said S-shaped portion and not less than about six inches so as to spread the contact of the upward force to be applied to a downward facing surface of the window along a line thereon sufficiently long to both avoid damage to the window and to provide lateral stability for the device when operated by one hand, the window engaging end of said blade having a rigid rounded end to facilitate the pivoting thereof about the variable line of contact with the window as the angle between the window and said lever arm changes, when in use, said rearwardly extending portion being approximately four times the length of said forwardly extending portion and adapted at the free end thereof to be grasped by the human hand, and said generally S-shaped portion having a pivot pin extending laterally therethrough a distance on both sides not less than about the width of said lever arm to thereby increase the lateral stability of the device; and (b) an elongated frame having a length approximately the length of the lever arm, said frame having a longitudinal slot extending from a point adjacent the lower end to a point adjacent the upper end from the window-facing side thereof through said frame to the user-facing side to receive the S-shaped portion of said lever arm therethrough, the user-facing side of said frame having a plurality of upwardly opening notches spaced along the length thereof within the length of said slot on opposite lateral sides thereof, each of said notches being adapted to selectively receive said laterally extending pivot pin, the lower end of said frame being tapered from the user-facing side thereof toward the window and terminating in a rigid rounded point to facilitate the pivoting of said frame toward and away from the window about the variable point of contact with the window sill when said device is in use, whereby pressing down on the rearwardly extending portion of said lever arm with one hand with the lower end of said frame positioned against the sill of the window and with the free end of said blade positioned against a downward facing surface of the window will provide a mechanical advantage to the user and thus assist in opening the window with one hand, with said frame, and thus the point of contact thereof with said lever arm, pivoting about the rounded lower end of said frame toward and away from the window to thereby reduce horizontal pressure on the window within the window frame, as the rearwardly extending portion of said lever arm is depressed to raise the window, with said blade pivoting about its variable line of contact with a downward facing surface of the window as the rearwardly extending portion of said lever arm is depressed to raise the window, and with the length of said variable line of contact and the length of said pivot pin contributing to the lateral stability of the device as the rearwardly extending portion of said lever arm is depressed to raise the window.

8. The device as defined in claim 7 wherein the taper of said lower end of said frame is approximately forty-five degrees from the user-facing side of said frame.

9. The device as defined in claim 7 wherein said pivot pin extends laterally a distance on both sides through and beyond said notches when the device is in use.

10. The device as defined in claim 7 wherein said plurality of upwardly opening notches are spaced approximately four inches apart.

11. The device as defined in claim 7 wherein said window engaging end of said blade is tapered at approximately a thirty-degree angle.

* * * * *